United States Patent [19]

Ohi et al.

[11] 3,957,491

[45] May 18, 1976

[54] SILVER HALIDE PHOTOGRAPHIC MATERIAL CONTAINING AN ORGANIC COMPOUND HAVING A COVALENT NITROGEN-HALOGEN BOND AS SENSITIZER

[75] Inventors: Reiichi Ohi; Keiichi Adachi; Norihiko Katoh; Kimitaka Kameoka; Mitsunori Sugiyama; Toshiaki Aono, all of Minami-ashigara, Japan

[73] Assignee: Fuji Photo Film Co., Ltd., Minami-ashigara, Japan

[22] Filed: Sept. 4, 1973

[21] Appl. No.: 394,013

[30] Foreign Application Priority Data

Sept. 4, 1972 Japan ..... 47-88526

[52] U.S. Cl. ..... 96/107; 96/108; 96/109

[51] Int. Cl.[2] ..... G03C 1/28

[58] Field of Search ..... 96/107, 108, 109, 101, 96/111

[56] References Cited

UNITED STATES PATENTS

| | | | |
|---|---|---|---|
| 1,994,170 | 3/1935 | Dabelow et al. | 96/101 |
| 2,288,586 | 6/1942 | Dersch et al. | 96/109 |
| 2,642,361 | 6/1953 | Damschroder et al. | 96/108 |
| 2,728,667 | 12/1955 | Knott et al. | 96/109 |
| 2,886,437 | 5/1959 | Piper | 96/107 |
| 3,186,848 | 6/1965 | Willems et al. | 96/111 |

OTHER PUBLICATIONS

Cotton; et al. = Advanced Inorganic Chemistry, Apr. 7, 1969, pp. 324–328.

*Primary Examiner*—Won H. Louie, Jr.
*Attorney, Agent, or Firm*—Sughrue, Rothwell, Mion & Zinn

[57] ABSTRACT

A silver halide photographic material having improved sensitivity unaccompanied by an increase in fog formation containing, in a photographic layer thereof, an organic compound having a nitrogen-halogen bond in the molecule.

20 Claims, No Drawings

SILVER HALIDE PHOTOGRAPHIC MATERIAL CONTAINING AN ORGANIC COMPOUND HAVING A COVALENT NITROGEN-HALOGEN BOND AS SENSITIZER

BACKGROUND OF THE INVENTION

1. Field of the Invention

The present invention relates to a silver halide photographic material and, more particularly, it relates to a silver halide photographic material having increased photosensitivity without being accompanied with the formation of fog.

2. Description of the Prior Art

In the production of silver halide photographic materials it has hitherto been desired to increase the photosensitivity and various methods have been proposed for this purpose. In particular, various investigations have been made on increasing the photosensitivity of silver halide photographic materials by incorporating therein various compounds at the chemical ripening step during the production of the photographic materials and further some of these methods have been employed industrially. As the sensitizers incorporated at the chemical ripening step described above, there are known such sulfur compounds as sodium thiosulfate, thiourea derivatives, etc.; such noble metal compounds as chloroauric acid, gold-thiosulfate complex salt, gold-rhodan complex salt, etc., and such reductive compounds are ferrous chloride and aminoiminomethanesulfonic acid. It is also known to use gelatin naturally containing sensitizers, to use a sulfur compound and a selenium compound together, to use a goldmercapto compound, and to use a gold compound and a phenol derivative together.

The practical conditions for conducting the chemical ripening treatment with or without the addition of such chemical sensitizers are restricted by the formation and increase of fog with the increase of sensitivity as the ripening progresses, that is to say, the extent of chemical ripening, i.e., the amount of the chemical sensitizer, the temperature of the chemical ripening, and the period of time for the chemical ripening are so selected that the formation of fog which is harmful is not oberserved. Also, the formation of fog during the preservation of photographic materials after coating and drying is promoted by inadequate chemical ripening and thus the conditions for chemical ripening are also restricted from this standpoint.

From the above reasons it will be easily understood that if the formation of fog is not accompanied by the progress of chemical ripening, it becomes possible to promote the extent of chemical ripening and increase the photographic sensitivity. Many compounds have been reported as antifoggants and it is known these compounds show antigogging activity. For instance, the use of benzenesulfinic acid and thiosulfonic acid together as described in U.S. Pat. No. 2,394,198, the use of benzenesulfinic acid amide as described in U.S. Pat. No. 3,498,792, the use of sugar mercaptal as described in U.S. Pat. No. 3,635,717, and the use of 1,2-glycol as described in U.S. Pat. No. 3,650,759, have been proposed. However, these compounds are insufficient for the aforesaid purpose or in other words, the desired satisfactory results are not obtained by using such known compounds.

SUMMARY OF THE INVENTION

As the results of various investigations, we have found that the formation of fog is remarkably inhibited by adding to a silver halide photographic material a compound having a nitrogen-halogen bond in the molecule. When the chemical ripening is carried out in the presence of this compound having a nitrogen-halogen bond, the effect of the chemical ripening is particularly remarkable, the formation of fog accompanied by the increase of sensitivity with the progress of the chemical ripening is remarkably suppressed, and further the formation of fog during the preservation of photographic materials after coating and drying and the formation of fog during development are also inhibited.

DETAILED DESCRIPTION OF THE INVENTION

As described above, this invention employs a compound having a nitrogen-halogen bond added to the photographic material so that when chemical ripening is conducted, the above described effects of minimization of fog are obtained. When the compound having a nitrogen halogen bond is incorporated after chemical ripening, it may not be easy to prevent the formation of fog caused by excessive chemical ripening but the effect of preventing the formation of fog is observed in case of preserving photographic materials at high-temperatures and high-humidity conditions or in case of developing photographic materials under conditions with which fog is easily formed, such as the use of a long development period, the use of high temperatures and high pH in development, and development in the presence of an aldehyde hardener. We have surprisingly found that our compounds provide sufficient antifogging effect without undesirable desensition when the compound is employed together with a gold sensitizer.

As described above, a compound having a nitrogen-halogen bond is effective. Particularly preferred examples of these compounds having a nitrogen-halogen bond in the molecule used in this invention are represented by the following general formula (I)

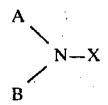

wherein X represents a halogen atom; A represents a hydrogen atom, an alkali metal atom, a R—CO— group or an R—$SO_2$— group; B represents a R′—CO— group, R′—$SO_2$— group, or R′; and R and R′ each represents a non-metallic atomic group, and R and R′ may combine to form a heterocyclic ring.

Suitable groups for R and R′ are 1. aliphatic groups such as alkyls (both substituted and unsubstituted), preferably having 1 to 8 carbon atoms with the suitable substituent being hydroxy, alkoxy, halogen, and the like;

2. aromatic groups such as phenyl, naphthyl (both substituted and unsubstituted), with suitable substituents being alkyl, alkoxy, halogen, and the like; and 3. heterocyclic groups such as pyridine;

Suitable hetero cyclic rings formed by R and R′ are phthalimide, succinimide, maleimide, caprolactam, hydantoin, barituric acid, cyanuric acid, saccharin, etc., which can contain substituents such as, halogen, alkyl, aryl alkoxy, and aryloxy on the ring.

These heterocyclic rings can be represented by the general formula

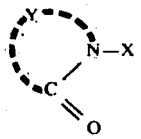

wherein Y represents the non-metallic atoms necessary to form a 5-, 6- or 7-membered ring with the

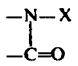

moiety, and X represents a halogen atom. The non-metallic atoms necessary to form the ring are selected from C, N, O, S, and Se. The ring can have a monovalent substituents such as halogen, alkyl, alkoxy, aryl, aryloxy or a 5- or 6-membered fused ring such as a benzene, cyclohexane, furan, or a pyridine ring. Suitable alkali metal atoms for A are sodium or potassium.

Specific examples of the compounds represented by the above-described general formula (I) are shown below:

Compound 1

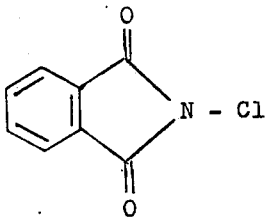

Compound 2

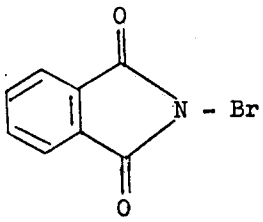

Compound 3

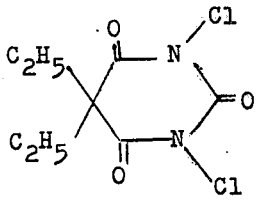

Compound 4

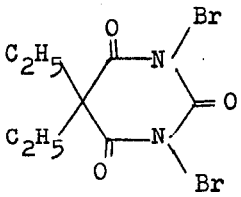

Compound 5

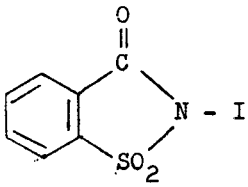

Compound 6

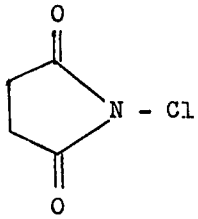

Compound 7

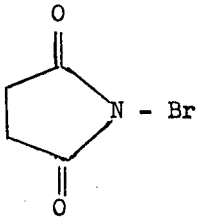

Compound 8

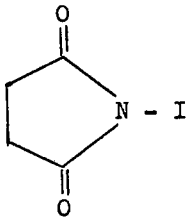

Compound 9

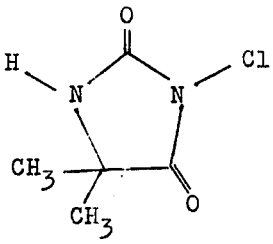

Compound 10
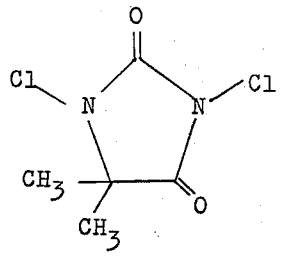
Compound 11
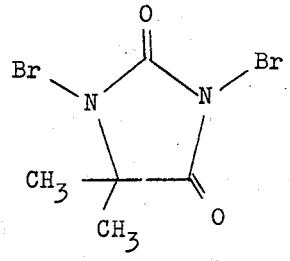
Compound 12
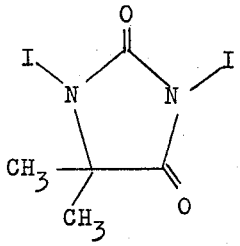
Compound 13
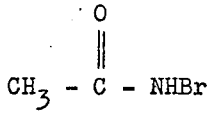
Compound 14
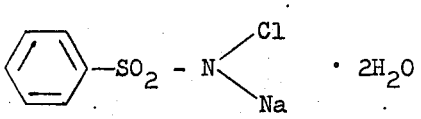
Compound 15
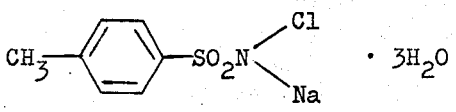
Compound 16
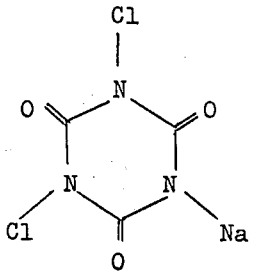
Compound 17
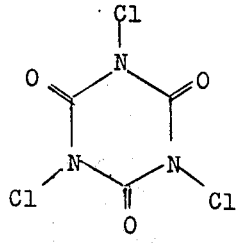
Compound 18
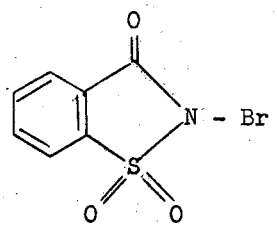
Compound 19
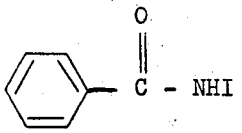
Compound 20
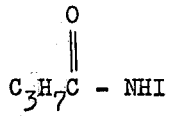
Compound 21
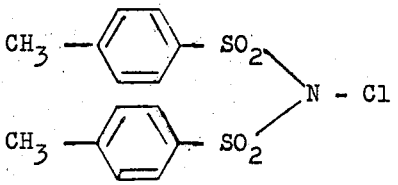

Compound 22

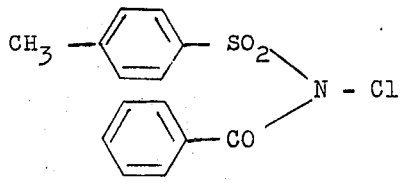

Compound 23

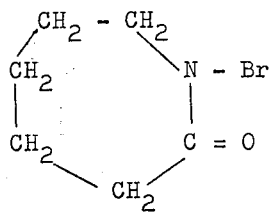

Most of these compounds represented by the general formula (I) are commercially available and those which are not can be prepared by the methods described in the literature (CHem. Abst. Vol. 51, page 2751 (1957), Chem. Berichte Vol. 33, page 21 (1900) or by similar methods.

The antifogging effect of the compound of this invention is particularly remarkable in a silver chloride emulsion, silver chlorobromide emulsion, and silver chloroiodobromide emulsion and the effect is essentially not influenced by the crystal habit of the silver halide crystals, the grain size of the silver halide crystals, and the grain size distribution of the silver halide crystals. The appropriate amount of the compound of the invention added at chemical ripening depends upon the kind and the amount of the sensitizers employed but is generally about 1 mg to 1 g per mol of silver halide, preferably about 5 mg to 300 mg per mol of silver halide. The compound can be added to the silver halide emulsion as a solution thereof in water or in an organic solvent such as a lower alcohol, e.g., methanol, ethanol, or isopropanol; acetone; ethylene glycol mono methyl ether; or mixtures thereof with water.

The effect of the compound of this invention will not be reduced by the presence of other conventional photographic additives. That is to say, the aforesaid compound of this invention can be used together with additives such as saponin, sodium dodecylbenzenesulfonate, and oleyl-N-methyltaurine. The compound of this invention can further be used together with surface active agents as described in U.S. Pat. Nos. 3,441,413; 3,415,649 and 3,545,974; 2.831,766; 2,739,891; and 2,823,125; hardeners such as mucochloric acid, 4,6-dichloro-2-hydroxy-triazine, 2,3-dihydroxydioxane, etc., as described in U.S. Pat. Nos. 2,080,019; 2,725,294; 2,725,295; 3,325,287; 3,232,764; 3,288,775; 2,732,303; 3,635,718; 3,232,763; 2,732,316; 2,586,168; 3,103,437; 3,017,280; 2,983,611; 3,100,704; 3,091,537; 3,321,313 and 3,543,292 and British Pat. Nos. 1,279,578 and 1,304,327; stabilizers for improving preservability such as 7-hydroxy-5-methyl-1,3,4,7a-tetraazaindene, etc.; optical sensitizers as described in U.S. Pat. Nos. 2,493,747; 2,493,748; and 2,503,776; chemical sensitizers as disclosed in U.S. Pat. Nos. 2,271,623; 2,288,226; 2,334,864; 3,046,132; 3,046,133; 3,046,134; and 3,046,135 and British Pat. No. 939,357; gold sensitizers such as those described in U.S. Pat. Nos. 2,540,085; 2,597,856; 2,597,915; and 2,399,083, various plasticizers and emulsified polymers for improving the physical property of gelatin films; sensitizers acting at development such as a polyoxyalkylene compound and a quaternary compound; antifoggants as described in U.S. Pat. Nos. 2,728,663; 2,728,664; 2,728,665; 2,728,666; 2,728,667; 2,131,038; 2,403,927; 2,377,375; 2,708,162; 2,394,198; 2,691,588; and British Pat. Nos. 403,789; 452,043; 893,428 and the azaindenes described in Zeitschrift für wissenschaftliche Photographic Vol. 47, pages 2–27 (1952) or the compounds described in U.S. Pat. No. 3,163,536 and British Pat. No. 1,183,784. By the use of the above-described compounds of this invention together with the above additives, the desired effects of the additives will not be reduced.

Also, the compounds of this invention are not only effective as an antifoggant for black and white negative photographic materials, black and white positive photographic materials, radiographic materials, and photosensitive materials for printing but also for color photographic materials containing oil-soluble or water-soluble color couplers and diffusion transfer color photographic materials using dye developing agents.

There are no particular restrictions on the supports used in this invention. That is to say, such supports as polyester films, cellulose triacetate films, glass plates, baryta-coated papers, resin-coated papers, synthetic papers, and metallic sheets or plates can be used as the supports for the photographic materials to which the compounds of this invention are effectively applied. As the binders for the silver halides to provide silver halide emulsions, there are gelatin, gelatin derivatives such as phthlated gelatin and maleated gelatin; and water-soluble polymers such as polyvinyl alcohol, polyvinyl pyrrolidone, polysaccharides, and acrylic acid copolymers. These can be used individually or as mixtures thereof.

The invention will now be explained in greater detail by reference to the following examples although the invention is not to be intepreted as being limited to these examples. Unless otherwise indicated, all percents and parts are by weight.

EXAMPLE 1

A silver chlorobromide emulsion containing 30 mol% silver bromide was chemically ripened to the maximum sensitivity using the compound of this invention as shown in Table 1 together with chloroauric acid as a gold sensitizer and sulfur sensitizing gelatin as a sulfur sensitizer. The silver halide emulsion was spectrally sensitized with 3-carboxymethyl-5-[3-methyl-2-(3-thiazolinylidene)ethylidene]-2-thio-2,4-(3,4)oxazoledione and after adding thereto 2,4-dichloro-6-hydroxy-S-triazine as a hardener, sodium dodecylbenzenesulfonate as a coating aid, and an aqueous dispersion of polyethyl acrylate as a plasticizer, the emulsion was coated on a polyethylene terephthalate film.

The photographic film was exposed for 10 seconds (320 CMS) to light at a color temperature of 2666°K from a tungsten lamp through an optical wedge having steps of 0.1, developed for 2 minutes at 20°C in the developer having the following composition, and then fixed in a fix solution containing sodium thiosulfate.

| Composition of the Developer: | | |
|---|---|---|
| N-Methyl-p-aminophenol Sulfate | 1 | g |
| Sodium Sulfite | 15 | g |
| Hydroquinone | 4 | g |
| Sodium Carbonate | 26 | g |
| Potassium Bromide | 0.6 | g |
| Water added to make | 1 | liter. |

The photographic properties of the samples thus obtained are shown in Table 1.

Table 1

| Compound | Amount* (mg/mol Agx) | Relative Sensitivity** | Fog |
|---|---|---|---|
| None (control) | — | 100 | 0.40 |
| Compound 2 | 10 | 115 | 0.30 |
| | 34 | 115 | 0.22 |
| | 102 | 112 | 0.20 |
| Compound 3 | 10 | 112 | 0.28 |
| | 34 | 115 | 0.24 |
| | 102 | 115 | 0.20 |
| Compound 6 | 34 | 101 | 0.26 |
| | 102 | 100 | 0.21 |
| Compound 8 | 34 | 98 | 0.28 |
| | 68 | 102 | 0.20 |
| | 136 | 98 | 0.18 |
| Compound 10 | 8 | 110 | 0.30 |
| | 34 | 110 | 0.20 |
| Compound 11 | 5 | 102 | 0.30 |
| | 17 | 110 | 0.25 |
| | 51 | 115 | 0.17 |
| Compound 12 | 34 | 96 | 0.18 |
| | 68 | 91 | 0.16 |
| | 102 | 93 | 0.12 |
| Compound 13 | 17 | 95 | 0.16 |
| | 34 | 92 | 0.12 |
| | 51 | 91 | 0.12 |
| Compound 15 | 20 | 105 | 0.29 |
| | 68 | 109 | 0.24 |
| | 204 | 106 | 0.19 |

*Each compound was added as the methanol solution thereof.
**The sensitivity of the point of fog + 0.1 was shown by setting that of the control sample (containing no compound of this invention) equal to 100.

From the results shown in Table 1 above it can be understood that by using compounds having a nitrogen-halogen bond according to this invention, the formation of fog was greatly prevented.

EXAMPLE 2

A silver chlorobromide emulsion containing 1 mol% silver iodide was chemically sensitized until the maximum sensitivity was obtained using the compound of this invention, as shown in Table 2 below, together with chloroauric acid as a gold sensitizer and sodium thiosulfate as a sulfur sensitizer. After adding to the silver halide emulsion the spectral sensitizing dye, the coating aid, and the plasticizer as described in Example 1 and mucochloric acid as a hardener, each of these in the amounts as described in Example 1, the silver halide emulsion was coated on a polyethylene terephthalate film. The photographic films thus prepared were exposed and developed as described in Example I. The results obtained are shown in Table 2.

Table 2

| Compound | Amount* (mg/mol AgX) | Relative Sensitivity** | Fog |
|---|---|---|---|
| None (control) | — | 100 | 0.46 |
| Compound 2 | 10 | 110 | 0.30 |
| | 34 | 109 | 0.24 |
| | 102 | 115 | 0.19 |
| Compound 8 | 34 | 98 | 0.26 |
| | 68 | 101 | 0.21 |
| | 102 | 105 | 0.15 |
| Compound 13 | 10 | 96 | 0.21 |
| | 34 | 94 | 0.17 |
| | 102 | 91 | 0.16 |
| Compound 15 | 20 | 101 | 0.31 |
| | 68 | 110 | 0.23 |
| | 204 | 108 | 0.18 |

*, **See notes to Table 1

From the results shown in the above table, the excellent fog inhibiting effect of the compounds of this invention is observed.

EXAMPLE 3

A silver iodobromide emulsion containing 5 mol% silver iodide was chemically ripened until the maximum sensitivity was obtained using the compound of this invention as shown in Table 3 together with a complex salt of sodium thiosulfate and gold ($Na_3 Au(S_2O_3)_2$) as a gold sensitizer and sodium thiosulfate as a sulfur sensitizer in the amount as described in Example 1. The silver halide emulsion was spectrally sensitized with anhydro-5,5'-dichloro-9-ethyl-3,3'-di(3-sulfopropyl)-thiacarbocyanine hydroxide and after adding thereto the hardener and the coating aid as described in Example 1 and also 4-hydroxy-6-methyl-1,3,3a,7-tetraazaindene, the resultant silver halide emulsion was coated on a triacetyl cellulose film.

The photographic films thus prepared were exposed (3.2 CMS) for 1/20 second through an optical wedge having steps of 0.2 to a tungsten lamp of 5400°K in color temperature using a color filter, developed for 7 minutes at 20°C in a developer having the following composition, and then fixed in a fix solution containing sodium thiosulfate as described in Example 1.

| Composition of the Developer: | | |
|---|---|---|
| N-Methyl-p-aminophenol Sulfate | 2 | g |
| Hydroquinone | 5 | g |
| Sodium Sulfite (anhydrous) | 100 | g |
| Borax | 2 | g |
| Water added to make | 1 | liter. |

The results obtained are shown in Table 3.

Table 3

| Compound | Amount (mg/mol AgX) | Relative Sensitivity | Fog |
|---|---|---|---|
| None (control) | — | 100 | 0.22 |
| Compound 4 | 50 | 102 | 0.12 |
| | 100 | 105 | 0.10 |
| | 200 | 98 | 0.10 |
| Compound 8 | 25 | 98 | 0.11 |
| | 50 | 98 | 0.06 |
| | 100 | 95 | 0.05 |
| Compound 11 | 25 | 105 | 0.17 |
| | 50 | 105 | 0.15 |
| | 100 | 100 | 0.15 |
| Compound 12 | 25 | 100 | 0.11 |
| | 50 | 98 | 0.06 |
| | 100 | 90 | 0.05 |

From the results set forth in Table 3, it can be seen that the excellent fog inhibitting effect of the compounds of this invention was observed.

EXAMPLE 4

A silver chloroidobromide emulsion containing 70 mol% silver bromide and 0.5 mol% silver iodide was chemically ripened until the maximum sensitivity was obtained using the compound of this invention together with gold thiocyanate as a gold sensitizer and sulfur sensitizing gelatin as a sulfur sensitizer in the amounts as described in Example 1. After adding to the emulsion the hardener and the coating aid as described in Example 1 and a coupler dispersion containing 2-methylbenzoyl-3-(2,4-di-tertamylphenoxyacetamido)acetanilide as a yellow coupler, the resultant silver halide emulsion was coated on a photographic support coated with polyethylene.

The photographic material thus prepared was exposed (500 CMS) for 1/2 second through an optical wedge having steps of 0.1 to a tungsten lamp of a color temperature of 2854°K using a color filter and processed with processing solutions having the following compositions at 30°C. In this case, the extent of fog formation in the case of conducting the development for a standard development time of 3.5 minutes was compared with the extent of fog formation in the case of development for 10 minutes.

Also, the photographic materials were stored for 2 days under high-temperature and high-humidity conditions of a temperature of 50°C and a relative humidity of 80% and then subjected to the standard development. The state of fog in this case was also determined.

| | | |
|---|---|---|
| Color Developer: | | |
| Sodium Metaborate | 25 | g |
| Sodium Sulfite | 2 | g |
| Hydroxylamine Sulfate | 2 | g |
| Potassium Bromide | 0.5 | g |
| 6-Nitrobenzimidazole Nitrate | 0.02 | g |
| Sodium Hydroxide | 4 | g |
| Benzyl Alcohol | 15.8 | ml |
| Diethylene Glycol | 20 | ml |
| N-Ethyl-N-β-(methanesulfoneamidoethyl)-p-phenylenediamine | 8 | g |
| Water added to make | 1 | liter. |
| Blix Solution: | | |
| Iron (III) salt of Ethylenediamine Tetraacetic Acid | 45 | g |
| Ammonium Thiocyanate | 10 | g |
| Sodium Sulfite | 10 | g |
| Ammonium Thiosulfate (60% aqueous solution) | 100 | ml |
| Ethylenediamine Tetraacetic Acid Tetrasodium Salt | 5 | g |
| Water added to make | 1 | liter |
| Stabilization Bath: | | |
| Tartaric Acid | 10 | g |
| Zinc Sulfate | 10 | g |
| Sodium Metaborate | 20 | g |
| Water added to make | 1 | liter. |

The results obtained are shown in Table 4.

Table 4

| Compound | Amount (mg/mol AgX) | A | (B) | (C) | (D) |
|---|---|---|---|---|---|
| None (control) | — | relative sensitivity | 100 | 115 | 107 |
| | | fog | 0.18 | 0.31 | 0.25 |
| Compound 12 | 200 mg | relative sensitivity | 102 | 115 | 110 |
| | | fog | 0.18 | 0.22 | 0.20 |

From the results shown in Table 4, it will be understood that the compounds of this invention showed good fog inhibitting effect in the case of a prolonged development period of time and also in the case of storing the photographic materials under high-temperature and high-humidity conditions.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing an organic compound having a covalent nitrogen-halogen bond, said organic compound is represented by the general formula (I)

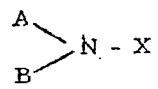

(I)

wherein X represents a halogen atom; A represents a hydrogen atom, an alkali metal atom, a R—CO— group, or a R—$SO_2$— group; B represents a R′—CO— group, a R′—$SO_2$— group, or R′; and R and R′ each represents a non-metallic atomic group selected from the class consisting of an alkyl group having 1–8 carbon atoms, a phenyl group, a naphthyl group or a pyridine group; said R and R′ may combine to form a heterocyclic ring of the general formula

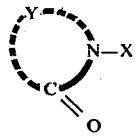

wherein Y represents the non-metallic atoms necessary to form a 5-, 6-, or 7-membered ring with said

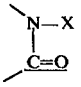

moiety, said organic compound being present in an amount sufficient to increase photosensitivity without increasing fog.

2. The silver halide photographic emulsion as set forth in claim 1, wherein said organic compound having a nitrogen-halogen bond is

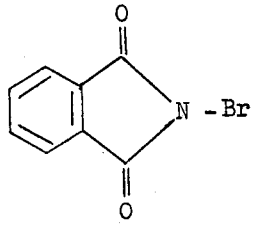

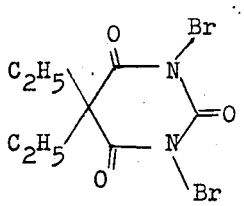

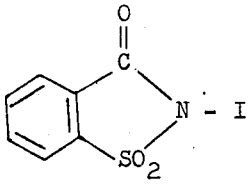

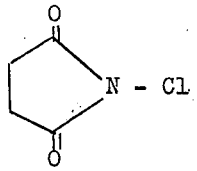

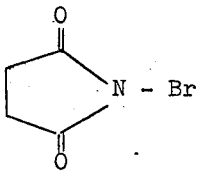

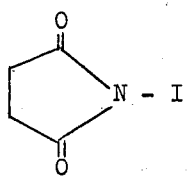

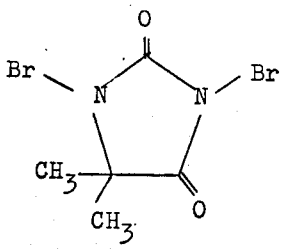

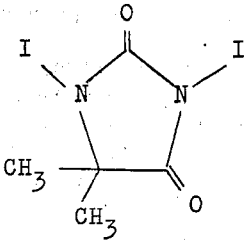

or

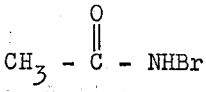

3. The silver halide photographic emulsions as set forth in claim 1, wherein said emulsion contain a gold sensitizer.

4. The silver halide photographic emulsion as set forth in claim 1, in which said organic compound having a covalent nitrogen-halogen bond is incorporated in the silver halide emulsion during the chemical ripening of the silvei halide emulsion in an amount of 1 mg to 1 g per mol of silver halide in said silver halide emulsion and further wherein said emulsion contains a gold sensitizer.

5. The silver halide photographic emulsion as set forth in claim 4, wherein the non-metallic atoms necessary to form said 5-, 6- or 7-membered ring are selected from C, N, O, S and Se.

6. The silver halide photographic emulsion as set forth in claim 5, wherein said 5-, 6- or 7-membered ring is selected from the group consisting of phthalimide, succinimide, maleimide, caprolactam, hydantoin, barbituric acid, cyanuric acid and saccharin.

7. A silver halide photographic material comprising a support having thereon a photographic layer containing an organic compound having a covalent nitrogen-halogen bond in the molecule, said organic compound is represented by the general formula (I)

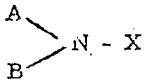

(I)

wherein X represents a halogen atom; A represents a hydrogen atom, an alkali metal atom, a R—CO— group or a R—$SO_2$— group; B represents a R′—CO— group, a R′—$SO_2$— group, or R′; and R and R′ each represents a non-metallic atomic group selected from the class consisting of an alkyl group having 1-8 carbon atoms, a phenyl group, a naphthyl group or a pyridine group, said R and R′ may combine to form a heterocyclic ring of the general formula

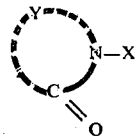

wherein Y represents the non-metallic atoms necessary to form a 5-, 6-, or 7-membered ring with said

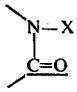

moiety, said organic compound being present in an amount sufficient to increase photosensitivity without increasing fog.

8. The silver halide photographic material as set forth in claim 7, in which said photographic layer containing said organic compound having a covalent nitrogen-halogen bond is a silver halide emulsion layer.

9. The silver halide photographic material as set forth in claim 8, in which said covalent organic compound having a nitrogen-halogen bond is incorporated in the silver halide emulsion layer during the chemical ripening of the silver halide emulsion.

10. The silver halide photographic material as set forth in claim 8, in which the amount of said organic compound having a covalent nitrogen-halogen bond is 1 mg to 1 g per mol of silver halide in said silver halide emulsion.

11. The silver halide photographic material as set forth in claim 7, wherein said organic compound having a nitrogen-halogen bond is

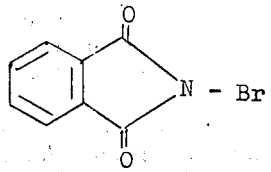

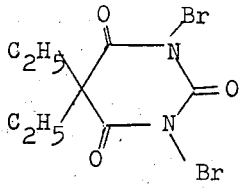

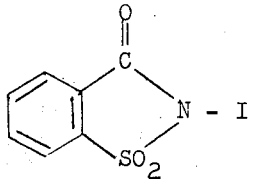

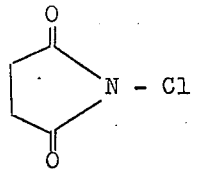

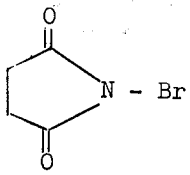

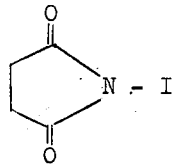

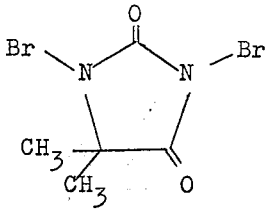

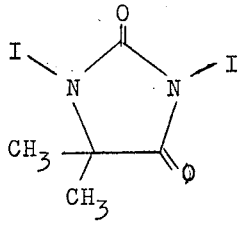

or

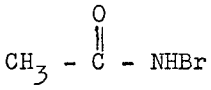

12. The silver halide photographic material as set forth in claim 8, wherein said emulsion contains a gold sensitizer.

13. The silver halide photographic material as set forth in claim 7, in which said organic compound having a covalent nitrogen-halogen bond is incorporated in the silver halide emulsion layer during the chemical ripening of the silver halide emulsion in an amount of 1 mg to 1 g per mol of silver halide in said silver halide emulsion and further wherein said emulsion contains a gold sensitizer.

14. The silver halide photographic material as set forth in claim 13, wherein the non-metallic atoms necessary to form said 5-, 6- or 7-membered ring are selected from C, N, O, S and Se.

15. The silver halide photographic material as set forth in claim 14, wherein aid 5-, 6- or 7-membered ring is selected from the group consisting of phthalimide, succinimide, maleimide, caprolactam, hydantoin, barbituric acid, cyanuric acid and saccharin.

16. A method of chemical ripening of a silver halide photographic emulsion comprising conducting said chemical ripening in contact with an organic compound having a covalent nitrogen-halogen bond in the molecule, said organic compound is represented by the general formula (I)

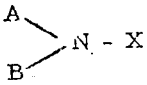

(I)

wherein X represents a halogen atom; A represents a hydrogen atom, an alkali metal atom, a R—CO— group or a R—$SO_2$— group; B represents a R′—CO— group, a R′—$SO_2$— group, or R′; and R and R′ each represents a non-metallic atomic group selected from the class consisting of an alkyl group having 1–8 carbon atoms, a phenyl group, a naphthyl group or a pyridine group, said R and R′ may combine to form a heterocyclic ring of the general formula

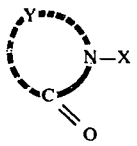

wherein Y represents the non-metallic atoms necessary to form a 5-, 6-, or 7-membered ring with said

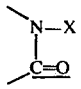

moiety, said organic compound being present in an amount sufficient to increase photosensitivity without increasing fog.

17. The method of chemical ripening as set forth in clam 16, wherein said emulsion contain a gold sensitizer.

18. The method of chemical ripening as set forth in claim 7, in which said organic compound having a covalent nitrogen-halogen bond is incorporated in the silver halide emulsion during the chemical ripening of the silver halide emulsion in an amount of 1 mg to 1 g per mol of silver halide in said silver halide emulsion and further wherein said emulsion contains a gold sensitizer.

19. The method of chemical ripening as set forth in claim 18, wherein the non-metallic atoms necessary to form said 5-, 6- or 7-membered ring are selected from C, N, O, S and Se.

20. The method of chemical ripening as set forth in claim 19, wherein said 5-, 6- or 7-membered ring is selected from the group consisting of phthalimide, succinimide, maleimide, caprolactam, hydantoin, barbituric acid, cyanuric acid and saccharin.

* * * * *